US005984202A

United States Patent [19]

Byles

[11] Patent Number: 5,984,202

[45] **Date of Patent: *Nov. 16, 1999**

[54] HYBRID LOW FLOW AND SPRAY IRRIGATION APPARATUS AND METHOD

[75] Inventor: Joe D. Byles, Fresno, Calif.

[73] Assignee: Nibco, Inc., Elkhart, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/847,670

[22] Filed: Apr. 24, 1997

Related U.S. Application Data

[60] Provisional application No. 60/016,177, Apr. 24, 1996, and provisional application No. 60/025,828, Sep. 4, 1996.

[51] Int. Cl.[6] ..... B05B 1/14; B05B 15/10

[52] U.S. Cl. ..... 239/205; 239/542

[58] Field of Search ..... 405/41, 42, 37, 405/39; 239/203–206, 542, 569, 580

[56] References Cited

U.S. PATENT DOCUMENTS

| | | | |
|---|---|---|---|
| 1,010,819 | 12/1911 | Thompson | 405/39 X |
| 3,572,630 | 3/1971 | Mundonshall | 405/41 X |
| 3,810,582 | 5/1974 | Lodge | 239/542 |
| 3,885,743 | 5/1975 | Wake | 239/542 |
| 4,930,934 | 6/1990 | Adkins | 239/542 X |
| 5,054,690 | 10/1991 | Olson | 405/39 X |
| 5,222,671 | 6/1993 | Smiley | 239/542 X |
| 5,253,807 | 10/1993 | Newbegin | 239/542 X |
| 5,335,857 | 8/1994 | Hagon | 239/204 |

*Primary Examiner*—Kevin Weldon

*Attorney, Agent, or Firm*—Russell D. Culbertson; Shaffer & Culbertson, LLP

[57] ABSTRACT

An apparatus providing low volume irrigation from a previously installed sprinkler irrigation system including one or more sprinkler heads connected to a water supply conduit. The apparatus includes a manifold (50) having a water distribution passage (34) therein. The water distribution passage (34) includes an inlet end (35) and an outlet end (36) with the outlet end adapted to receive a conveyance channel (38) for distributing water to an emission point (42, 43). A flow control device (39) is associated with the water distribution passage (34) to control the flow rate of water through the passage to a rate exceeding a local hydraulic loading rate of the soil in the area around the emission point (42, 43). The manifold (50) is connected to receive water which is supplied to the sprinkler head through the water supply conduit. The manifold (50) may be connected to the sprinkler head body (22) or to the conduit (28) below the sprinkler head body and may replace the sprinkler type irrigation completely or supply irrigation supplemental to the sprinkler type irrigation.

14 Claims, 9 Drawing Sheets

HYBRID LOW FLOW AND SPRAY IRRIGATION APPARATUS AND METHOD

This application claims the benefit of U.S. Provisional Patent Application No. 60/016,177 filed Apr. 24, 1996, and also, U.S. Provisional Patent Application No. 60/025,828 filed Sep. 4, 1996.

BACKGROUND OF THE INVENTION

This invention relates to irrigation, and more particularly to an apparatus and method for a hybrid low volume and sprinkler irrigation system. The invention provides a site selectable arrangement for providing a new, low volume method of irrigation along with a conventional irrigation method, both from a convention sprinkler head installation.

Abroad and in the United States, a large percentage of potable, fresh water consumption is utilized for irrigating landscape and ornamental plantings. The state of the art irrigation systems utilized for delivering this water to landscape plantings are inefficient and contribute greatly to the exhaustion of water reserves in many areas. Sprinkler head systems are most commonly used for landscape purposes. The goal of a sprinkler head system is to evenly distribute the water through the air to a given area at a rate equivalent or less than the hydraulic loading rate or water infiltration rate of the surrounding soil. At this rate, the evenly distributed airborne water droplets fall to the ground and are absorbed into the soil.

However, the tiny spray droplets necessary to achieve uniform water distribution are vulnerable to wind and are more often than not blown out of the area intended to be irrigated, contributing to the over spray problems. Run-off occurs because the sprinkler heads tend to deliver water to an area too quickly for the water to be effectively absorbed into the ground. In addition, water droplets from the sprinkler head systems tend to impinge on surrounding structures such as houses, fences, and vehicles for example, causing discoloration, staining, and other damage. Despite these limitations, sprinkler irrigation systems easily make up the majority of landscape irrigation systems installed today.

Low volume surface drip irrigation devices and lines, typically emitting water in the range of 0.5 to 2 gallons per hour, use an extensive network of conduits. Emitters are attached to the conduits and are spaced apart on the surface of the area to be irrigated. The water drips from these emitters at slow rates and is mainly influenced by capillary action and gravity once the water enters the soil area directly around the emission point. Delivery of water in this manner does eliminate over spray and run-off, but is only practical for landscape plantings in areas not subject to traffic or heavy maintenance. Even in landscapes, surface drip irrigation is not practical for dense plantings with shallow root zones such as ornamental ground covers or turfs. If surface drip irrigation were used in traffic areas, such as lawns, the lines would have to be laid down 12 to 18 inches apart from each other and taken up in between irrigations to allow the lawn to be used and maintained. This impracticality, combined with the detracting visual appearance of the lines placed every 12 to 18 inches along the surface of the lawn, make surface drip irrigation totally unacceptable.

Subsurface drip irrigation systems consist of low volume drip emitter lines, with drip emission rates ranging from 0.5 to 2 gallons per hour. The lines and emitters are placed beneath the soil surface in order to provide watering in the root zone. The lines commonly consist of extruded polyethylene tubes with calibrated emission drip devices either inserted onto or into the tube. The water is emitted at regular intervals along the line buried below the soil surface and is distributed by the effects of capillary action in the soil and gravity. The lines are typically buried 6 to 8 inches below the soil surface and are spaced 12 to 18 inches apart in order to attempt to provide uniform watering to the top soil layers in between and above the drip lines.

However, due to the effects of gravity combined with the capillarity of the soil below the drip lines, more than 50% of the water percolates below the drip line level and is not available to the lawn and shallow rooted plantings. In addition to inefficiencies, these buried lines and emission devices are plagued with problems of plugging due to the ingrowth of plant roots. State of the art solutions to this root ingrowth problem have consisted of using toxic chemicals impregnated within the lines or emission devices or injected into the irrigation water to kill the roots around the emission devices. Even if roots are kept out through chemical treatments, soil may work into the emission devices due to the low velocity and mass flow rate of the water exiting the emission devices and this soil may also plug the devices. The subsurface emitters may also be plugged by insects, insect eggs, and various other natural blocking agents.

SUMMARY OF THE INVENTION

It is a general object of the invention to overcome the above-described limitations and other problems associated with prior irrigation devices and methods. More particularly, it is an object of the invention to provide a device and method for low volume irrigation in combination with, or in lieu of, a standard sprinkler irrigation system.

In order to accomplish these objects, one form of the invention includes a device which replaces the internal working mechanism of a typical sprinkler head device. The replacement device includes a manifold cap having one or more water distribution passages formed therein. Each water distribution passage is adapted to connect to a conveyance channel which is buried in the area to be irrigated and leads to an emission point at a remote location from the sprinkler head device. A flow controlling device is associated with each water distribution passage to control the flow through each water distribution passage and conveyance channel. The flow from the manifold can be controlled using any of the many commonly available state of the art devices such as, for example, throttling valves or restrictive orifice diaphragms which change available flow area as the upstream pressure changes. The manifold cap may also include a screen for filtering debris from the irrigation water prior to entering the water distribution passages.

This preferred form of the invention is installed in a previously installed sprinkler irrigation system by unscrewing the internal mechanism of the conventional sprinkler head and attaching in its place the manifold cap device. Following installation in the sprinkler head, the flow from each individual water distribution passage or port is directed to an area removed from the sprinkler head location via the respective conveyance channel which is preferably buried below the aeration depth in the area to be irrigated and brought up to the surface at an emission point where water is to be applied to the area to be irrigated. The flow through the water distribution passage is controlled to a high enough flow rate to cause localized spread of water by exceeding the infiltration rate or hydraulic loading rate of the soil. Roots and thatch in the area assist the spread of the water around the emission points. The spread of water is, therefore, less effective by gravity and evenly distributed within the root zones. The higher flow rate through the conveyance channels also flushes the channels continuously during each irrigation cycle and minimizes plugging.

The conveyance channels and surface emission points are preferably spread out in a polar array around the sprinkler head so as to effect full coverage of the area with efficient irrigation in the root zone. In this manner, the invention can easily be retro-fitted into the many previously installed sprinkler head irrigation systems without having to redesign the systems.

In an alternate form of the invention, the manifold cap includes a pop-up sprinkler device and a mechanism to switch between the pop-up sprinkler head device or the water distribution passages, or to use both simultaneously. The mechanism to switch between the water distribution passages or sprinkler device preferably includes a plurality of valves on associated with each water distribution passage and a separate valve associated with the sprinkler head.

In another alternate form, the invention includes a device body which is connected below the spray head as a replacement to the riser conduit or in addition to the riser conduit which provides fluid communication between the underlying water supplying tubing network and the sprinkler head. Where the device body comprises a replacement for the riser conduit, the device body preferably includes a series of axially aligned threaded connectors. Thus, the device body may be cut to a desired length leaving one of the threaded connectors to connect to the underlying buried tubing. This alternate form of the invention also preferably includes a valve for each water distribution passage which allows some or all of the water distribution passages to be closed off.

Alternatively to a separate manifold or device body, the water distribution passages and flow control devices may be incorporated into a sprinkler head itself. The water distribution and flow control arrangement may be molded into the sprinkler head body or added by a suitable process to a previously molded sprinkler head body. In this form of the invention, the standard sprinkler head is simply removed and replaced with the sprinkler head having the water distribution passages and flow control.

According to the method of the invention, water is supplied through a water supply conduit associated with a previously installed sprinkler irrigation system. The water is supplied through a sprinkler head connector associated with the water supply conduit to a manifold connected to the sprinkler head connector. The method also includes directing water from the manifold to a remote area to be irrigated through a buried conveyance channel having an emission end positioned generally at the surface of the area to be irrigated. The method includes controlling the flow through the conveyance channel to a rate exceeding the hydraulic loading rate of the area adjacent to the conveyance channel emission end. Water emitted at this rate produces localized run-off around the emission end and an extended wetting pattern around the emission end.

The apparatus and method according to the invention provide continuous, efficient water distribution for turf or dense plantings. The method and apparatus provide a positive, mechanical means for preventing roots from growing into the emission devices via the subsurface conveyance channel and its mechanical connection to the emission device. Furthermore, the apparatus provides a field switchable arrangement between sprinkler and non-sprinkler irrigation, particularly low energy precision flood irrigation. The non-sprinkler form of irrigation is not be effected by wind, over spray, and run-off.

DESCRIPTION OF THE PREFERRED EMBODIMENTS

Figure 1:
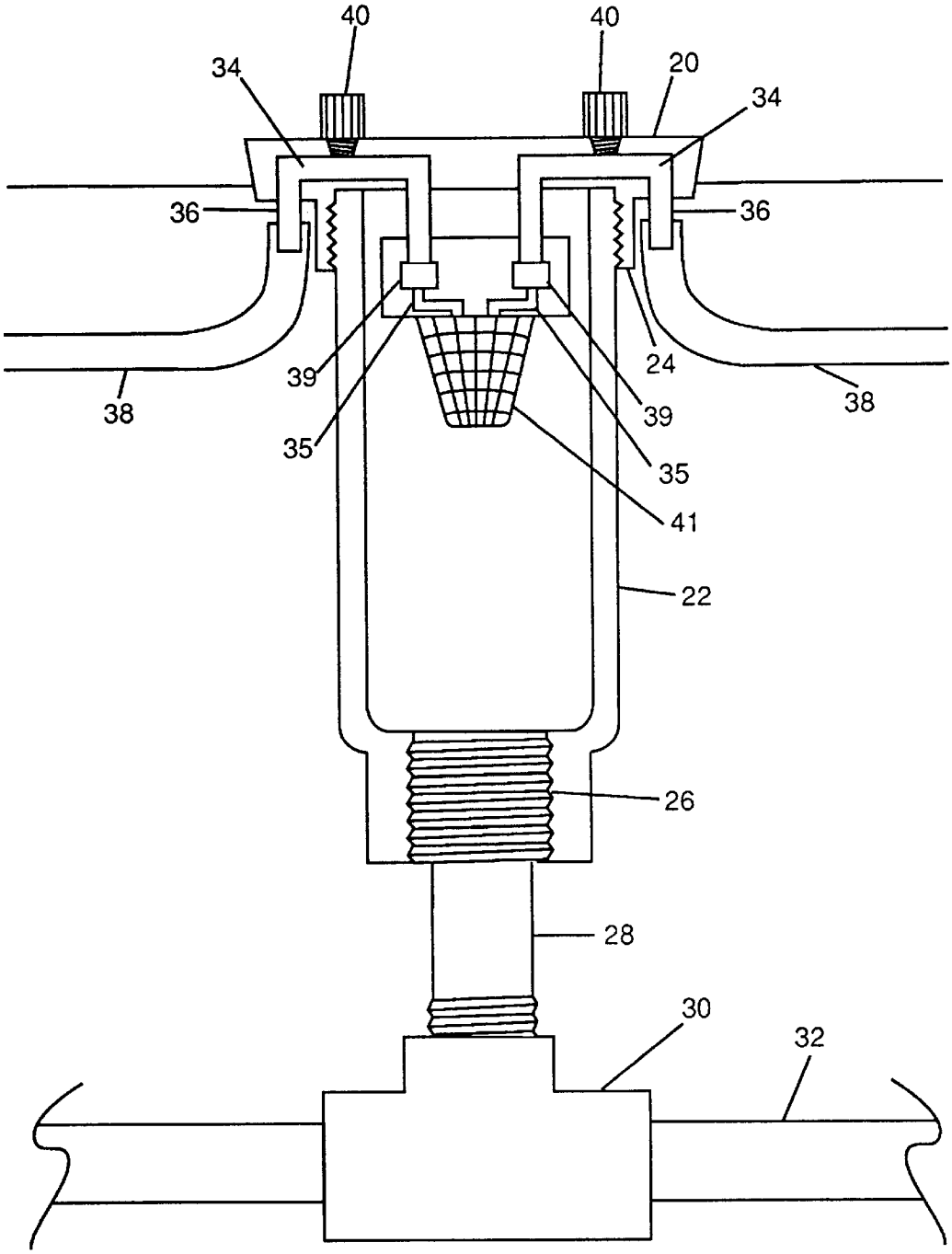
FIG. 1 is a partial section view of a sprinkler head having a manifold embodying the principles of the invention.

FIG. 1 illustrates a form of the invention which completely replaces a sprinkler type irrigation system with a non-sprinkler irrigation system, particularly a low flow or low energy precision flooding type irrigation system. The apparatus according to the invention includes a manifold 20 which is secured to a sprinkler head body 22 with the connector 24 at the top of the sprinkler head body. The manifold 20 forms a cap which replaces the pop-up or other sprinkler mechanism which was previously secured to the sprinkler head top connector 24. The sprinkler head body 22 includes a lower threaded portion 26 which connects to a riser nipple or conduit 28. The riser conduit 28 connects to a "tee" 30 fitted in a water supply line or conduit 32. The water supply line 32, riser 28, and sprinkler head body 22 are all buried below the soil surface S with the manifold cap 20 preferably immediately below the soil surface or at the soil surface.

The manifold 20 includes a plurality of water distribution passages 34 each having an inlet end 35 and an outlet end 36. The inlet end 35 of each water distribution passage 34 is exposed to the cavity 37 formed within the sprinkler body 22 in position to receive water supplied to the sprinkler body. The outlet end 36 includes a suitable connection such as a barb connector for connecting to a conveyance channel or tube 38. Also, a flow control device or means 39 is associated with each water distribution passage 34. The flow control device 39 serves to limit the flow through the passage 34 to a desired flow rate described below. In the preferred form of the invention shown in FIG. 1, each water distribution passage 34 further includes a cut-off valve 40 which may be used to completely or partially block the flow of water through the particular water distribution passage. A screen 41 may be included with the manifold 20 to filter debris from water reaching the water distribution passages 34.

The manifold device 20 is manufactured from any material suitable for irrigation components such as polycarbonate plastic, for example. The conveyance channels 38 may be made from polyethylene or other suitable flexible plastic material. The flow controlling devices may be formed from a rubber or silicone. The preferred flow controlling device includes a passage (not shown) through a flexible material. The passage reduces in area in response to a higher pressure on the upstream side of the device. The variable flow area controls the flow rate to the desired rate for a range of water supply pressures.

Figure 2:
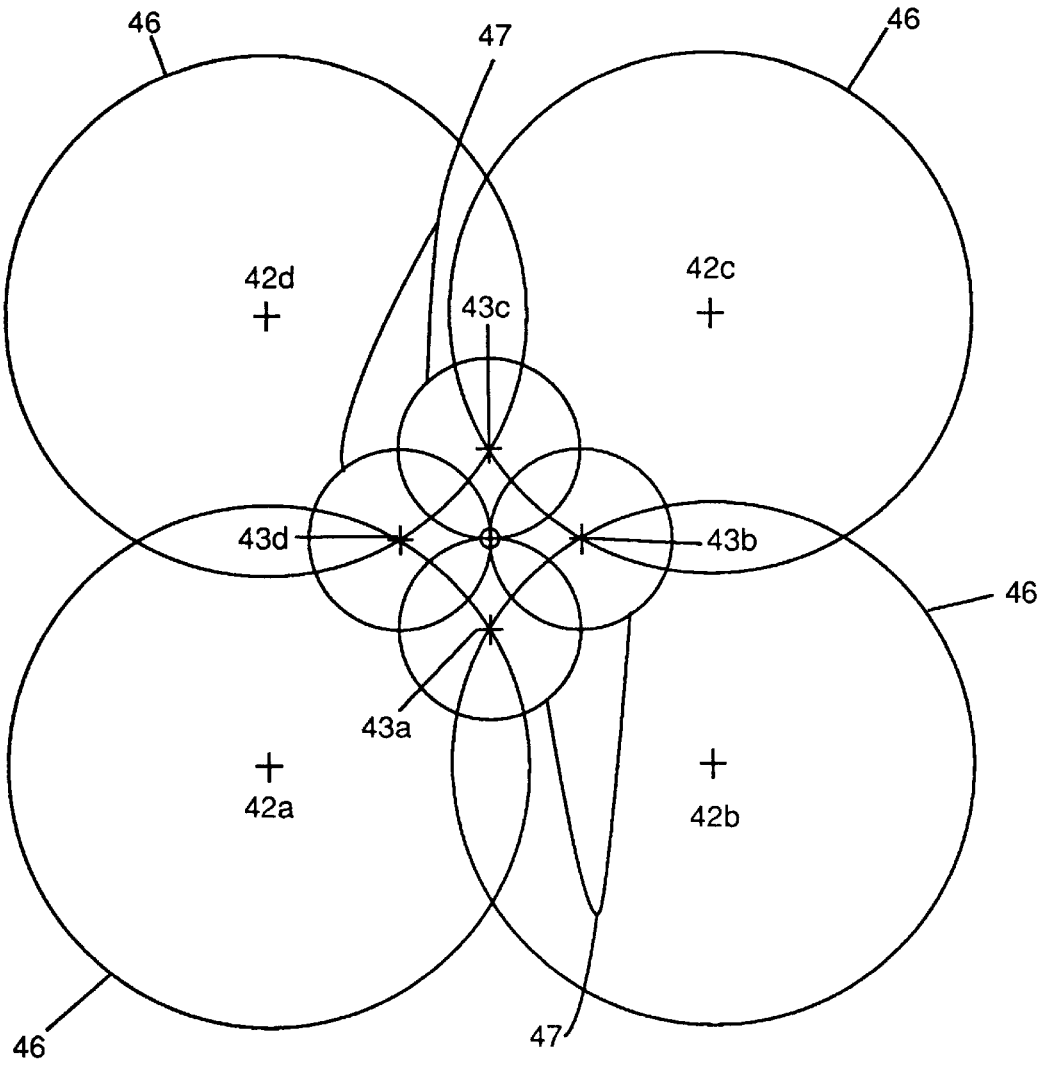
FIG. 2 is a diagrammatic view showing the wetting pattern which may be produced with the manifold shown in FIG. 1.

Referring to FIGS. 1 and 2, the manifold 20 may include eight water distribution passages 34 to accommodate eight conveyance channels 38, for example. Although eight conveyance channels are shown for purposes of illustration, more or fewer may be used and arranged in any pattern to produce the desired watering pattern. In the form of the invention shown in FIG. 1 in which the manifold 20 completely replaces a sprinkler mechanism, the conveyance channels 38 are preferably arranged radially. Four conveyance channels 38 may extend to distant emission points 42*a*, 42*b*, 42*c*, and 42*d* while another four conveyance channels 38 extend to closer emission points 43*a*, 43*b*, 43*c*, and 43*d*. Each conveyance channel 38 is buried below the soil surface with the distal end rising to the surface so that irrigation water may flow from the conveyance channel to the surface and spread out over the surface.

The flow rate through each conveyance channel 38 and water distribution passage 34 associated therewith is controlled to exceed the local hydraulic loading or infiltration rate in the area around the respective emission point. The hydraulic loading rate is effected by the nature of the soil, the density of plantings and roots in the root zone, and the nature of any thatch layer present on the surface of the soil. By exceeding the local hydraulic loading rate, the water exiting the conveyance channels 38 at the respective emission point 42*a*, 42*b*, 42*c*, or 42*d* or 43*a*, 43*b*, 43*c*, or 43*d* spreads out around the emission point to produce an extended wetting pattern such as wetting patterns 46 and 47 shown in FIG. 2. The size of the pattern depends upon the amount by which the flow rate exceeds the local hydraulic loading rate. For example, the wetting pattern 47 near the manifold may be produced with a 10 gallon per hour flow rate, while the patterns 46 may be produced with a 20 gallon per hour flow rate. Flow rates may range from 2 gallons per hour to 4 gallons per minute, while the most common flow rates range from 10 gallons per hour to 30 gallons per hour.

Figure 3:
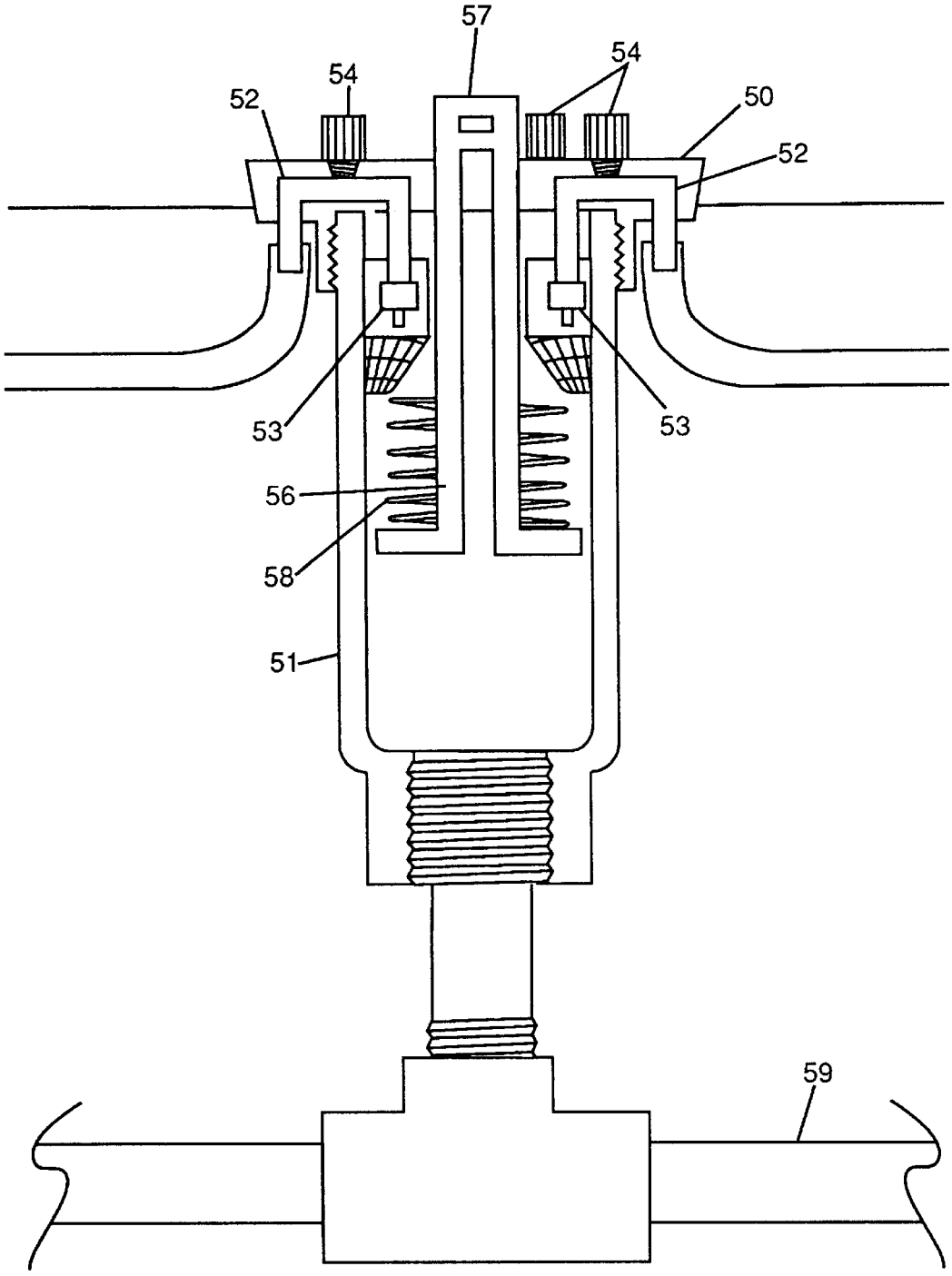
FIG. 3 is a partial section view of a sprinkler head having a manifold/sprinkler secured thereto.

FIG. 3 shows an alternative form of the invention which retains a conventional sprinkler capability in addition to providing a manifold 50 for irrigation through conveyance channels. The manifold 50 forms a cap which is attached to a previously installed sprinkler head body 52 similar to the embodiment shown in FIG. 1. The manifold 50 includes one or more water distribution passages 52, each with a flow control device 53 and a valve 54. The manifold 50 shown in FIG. 3 also includes a sprinkler mechanism opening 55 with a sprinkler stem 56 extending therethrough. The sprinkler stem 56 includes a spray head 57 at its top and preferably includes a mechanism (not shown) incorporated in the spray head to adjust the spray pattern or block the spray off completely. A spring 58 associated with the sprinkler stem 56 helps retract the stem back into the sprinkler head body 51 when it is not receiving irrigation water through the water supply conduit 59.

Figure 4:
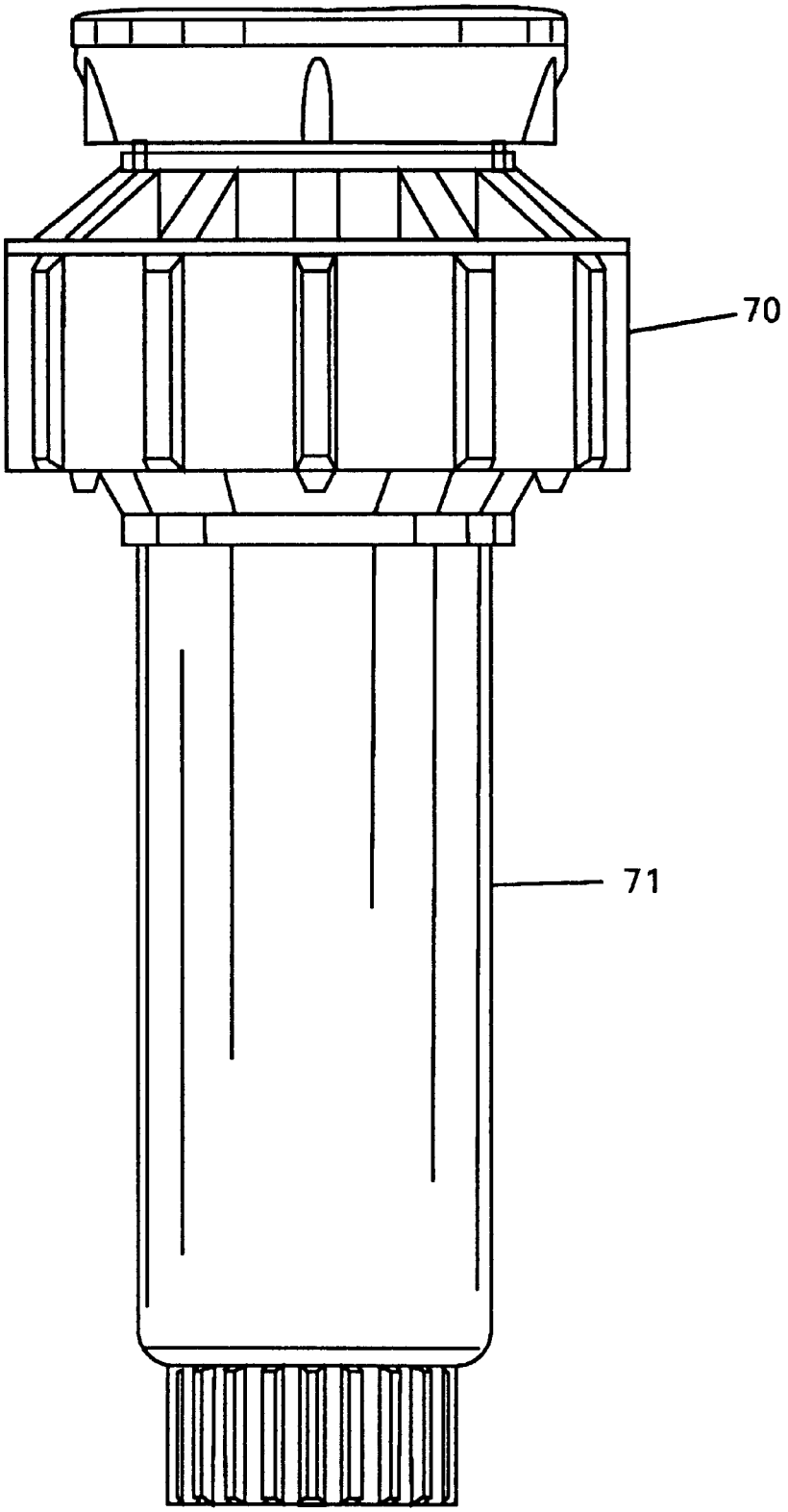
FIG. 4 is a side view of an alternate form of the manifold embodying the principles of the invention.
Figure 5:
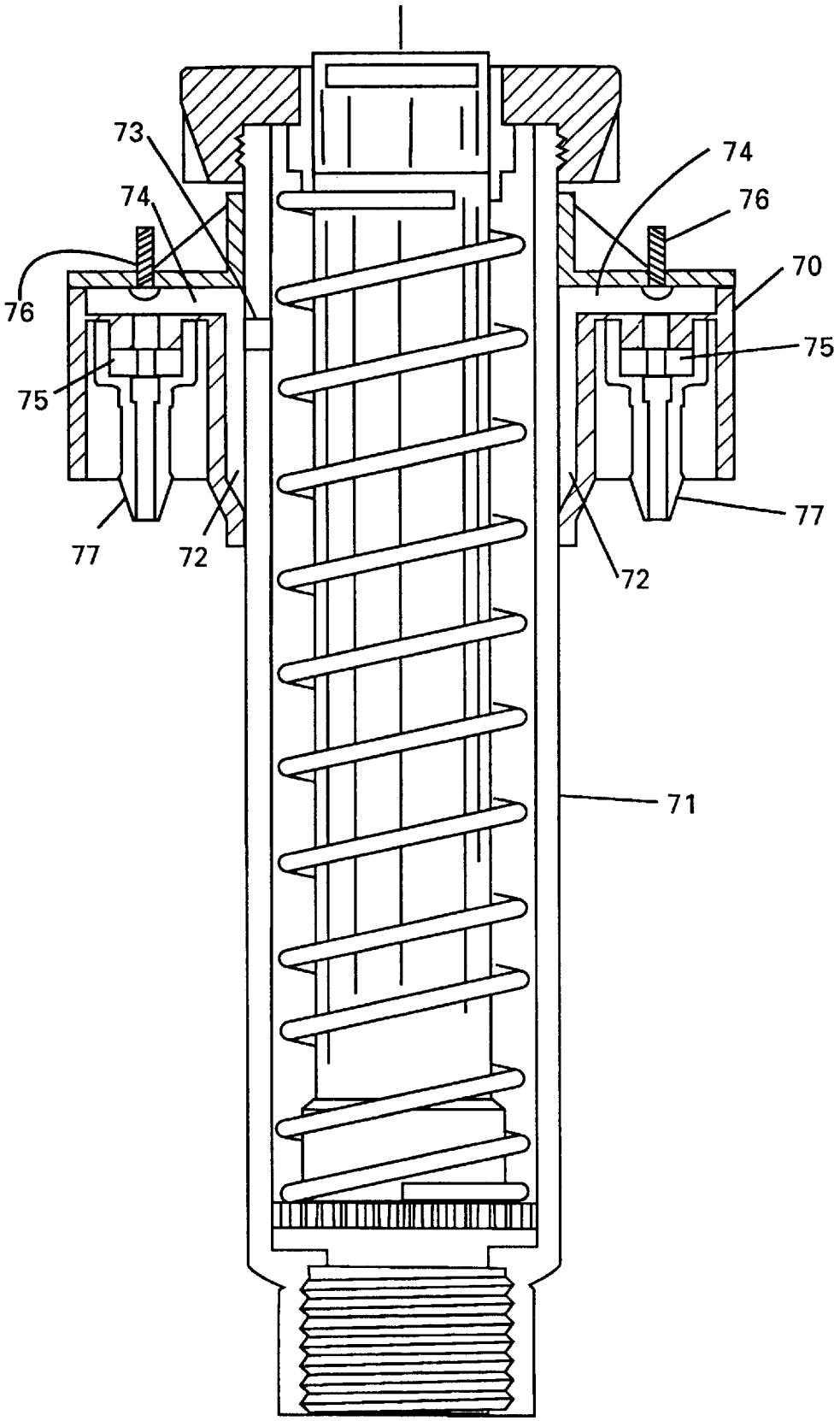
FIG. 5 is a view in section taken along line 5—5 in FIG. 4.

FIGS. 4 and 5 show an alternate form of the invention in which the manifold 70 comprises a ring which is secured around the body 71 of a standard sprinkler head. In this form of the invention, the manifold ring 70 slides over the sprinkler head body 71 with close tolerance leaving an annulus 72. The annulus 72 is positioned adjacent to an opening 73 which is drilled other otherwise formed through the sprinkler head body 71. In this position, with the annulus 72 aligned with the opening 73 through the sprinkler head body, the manifold ring 70 is glued, chemically welded, or otherwise fixed in place and sealed to the sprinkler head body.

The manifold ring 70 includes a plurality of water distribution passages 74 similar to the embodiment shown in FIGS. 1 and 3. A flow control device 75 and a valve 76 is associated with each water distribution passage 74. The outlet end of each water distribution passage includes a barb connector 77 or other suitable connector for accepting a conveyance channel (not shown in FIGS. 4 and 5). In this form of the invention, the barbed outlet end 77 of each water distribution passage 74 is directed downwardly and shielded by the manifold 70 to help prevent debris from entering the water distribution passages during the installation process.

The form of the invention shown in FIGS. 4 and 5 replaces the previously installed sprinkler head (not shown) in the sprinkler head irrigation system. The previously installed sprinkler head is simply removed and replaced with the new sprinkler head body 71 having the manifold ring 70 secured thereto. Alternatively, the previously installed sprinkler head may be removed and modified by the addition of the manifold ring 70 and then replaced into the irrigation system.

Figure 6:
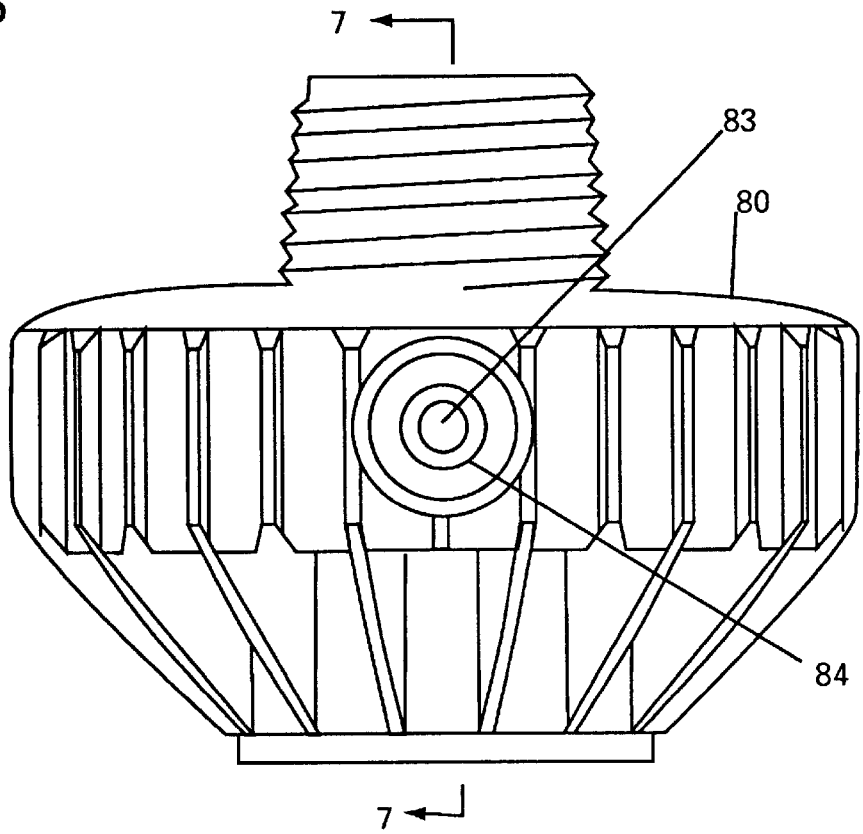
FIG. 6 is a side view of another alternate form of the invention.
Figure 7:
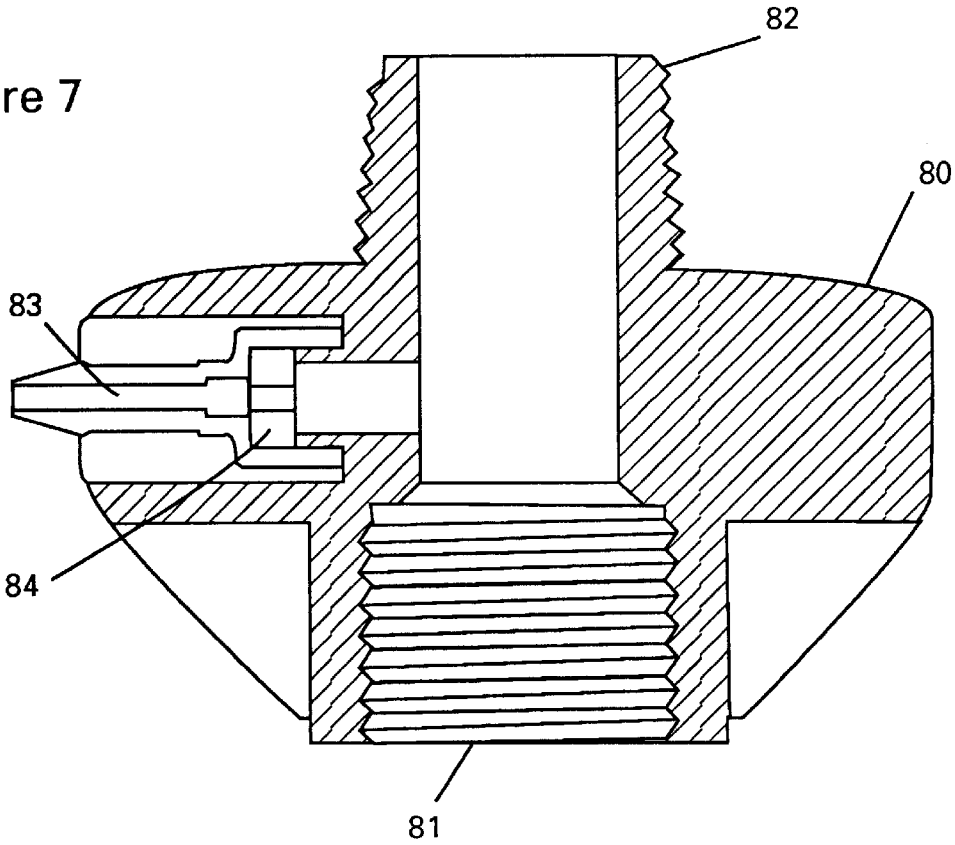
FIG. 7 is a view in section taken along line 7—7 in FIG. 6.

FIGS. 6 and 7 show another alternate form of the invention which is adapted to be secured in a previously installed sprinkler system below a standard sprinkler head. The device includes a device body 80 with a lower connection 81 for securing the device to the water supply conduit or a riser connected to the water supply conduit (not shown in FIGS. 6 and 7). An upper connection 82 is adapted to receive a standard sprinkler head device (not shown). In this form of the invention, the device includes a single water distribution passage 83 which includes a flow control device 84 similar to the previously illustrated embodiments. The form of the invention as shown in FIGS. 6 and 7 does not include a cut-off valve, but such a valve may be included in this alternate form of the device if desired.

The device illustrated in FIGS. 6 and 7 is particularly adapted to irrigate deficiency areas in a sprinkler irrigation pattern. Once a deficiency area is identified in a sprinkler irrigation pattern, one of the sprinkler heads in the system may be removed temporarily and a device such as that shown in FIGS. 6 and 7 installed. A conveyance channel may then be extended with its distal end running to the center of the deficiency area.

Figure 8:
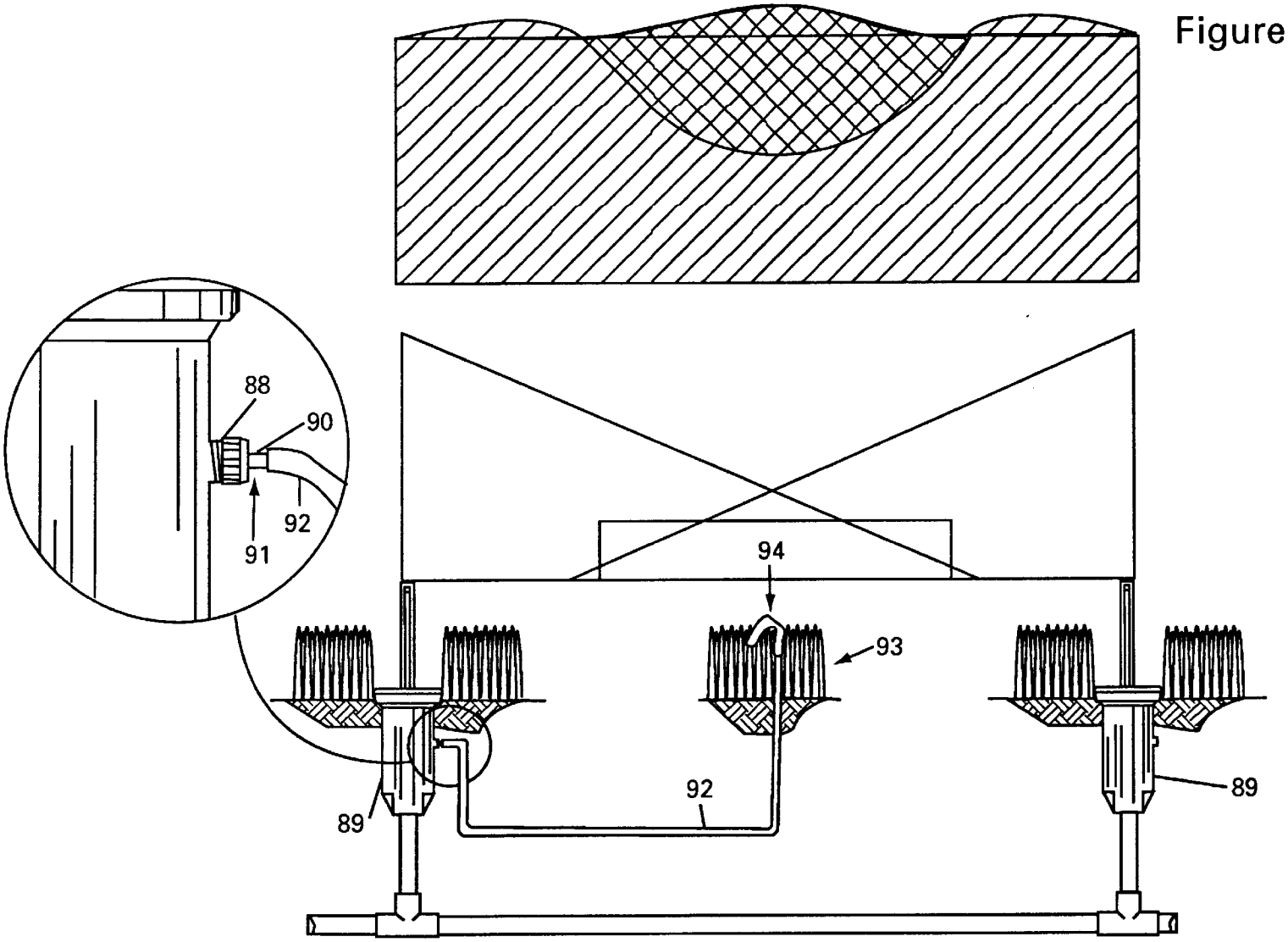
FIG. 8 is a side view showing another alternate form of a sprinkler and manifold embodying the principles of the invention and the wetting pattern which may be produced with the device.

FIG. 8 illustrates another alternate form of the invention with particular application in providing supplemental irrigation to a deficiency area in a sprinkler system wetting pattern. In this form of the invention, the water distribution passage 87 is formed in a nipple 88 which is integrally molded or otherwise formed in the body 89 of the sprinkler head 86. A cap 90 fits over the nipple 88 and includes the outlet end 91 of the water distribution passage to which a conveyance channel 92 may be connected. Although not show in FIG. 8, a flow control is associated with the water distribution passage 87 and is preferably incorporated into the cap 90. The cap may also include a valve similarly to the embodiment shown in FIG. 1. Where supplemental irrigation is not required through the particular sprinkler head 86, the nipple 88 may include simply a sealing cap to prevent water from exiting through the nipple.

The combined sprinkler/manifold device 86 is installed in a sprinkler system preferably adjacent to a deficiency area 93 which does not receive sufficient irrigation through the sprinkler associated with standard sprinkler heads 86. Once the deficiency area 93 is identified, the conveyance channel 92 may be installed with an emission point 94 generally in the center of the deficiency area. In operation, the sprinkler heads 86 continue to provide irrigation in the standard sprinkler pattern and the deficiency area 93 is irrigated through the conveyance channel 92.

Figure 9:
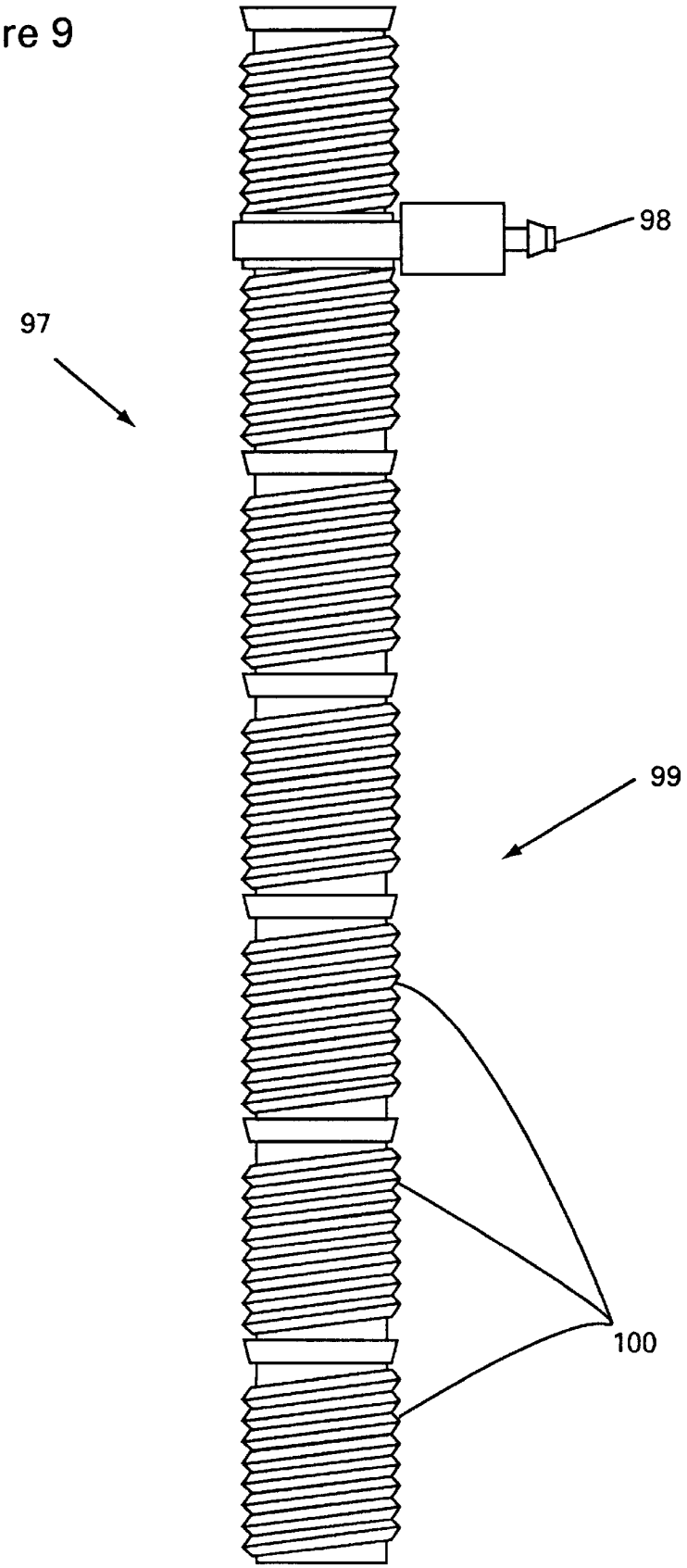
FIG. 9 is a side view of another alternate form of the invention which has the manifold incorporated into an adjustable length riser.
Figure 10:
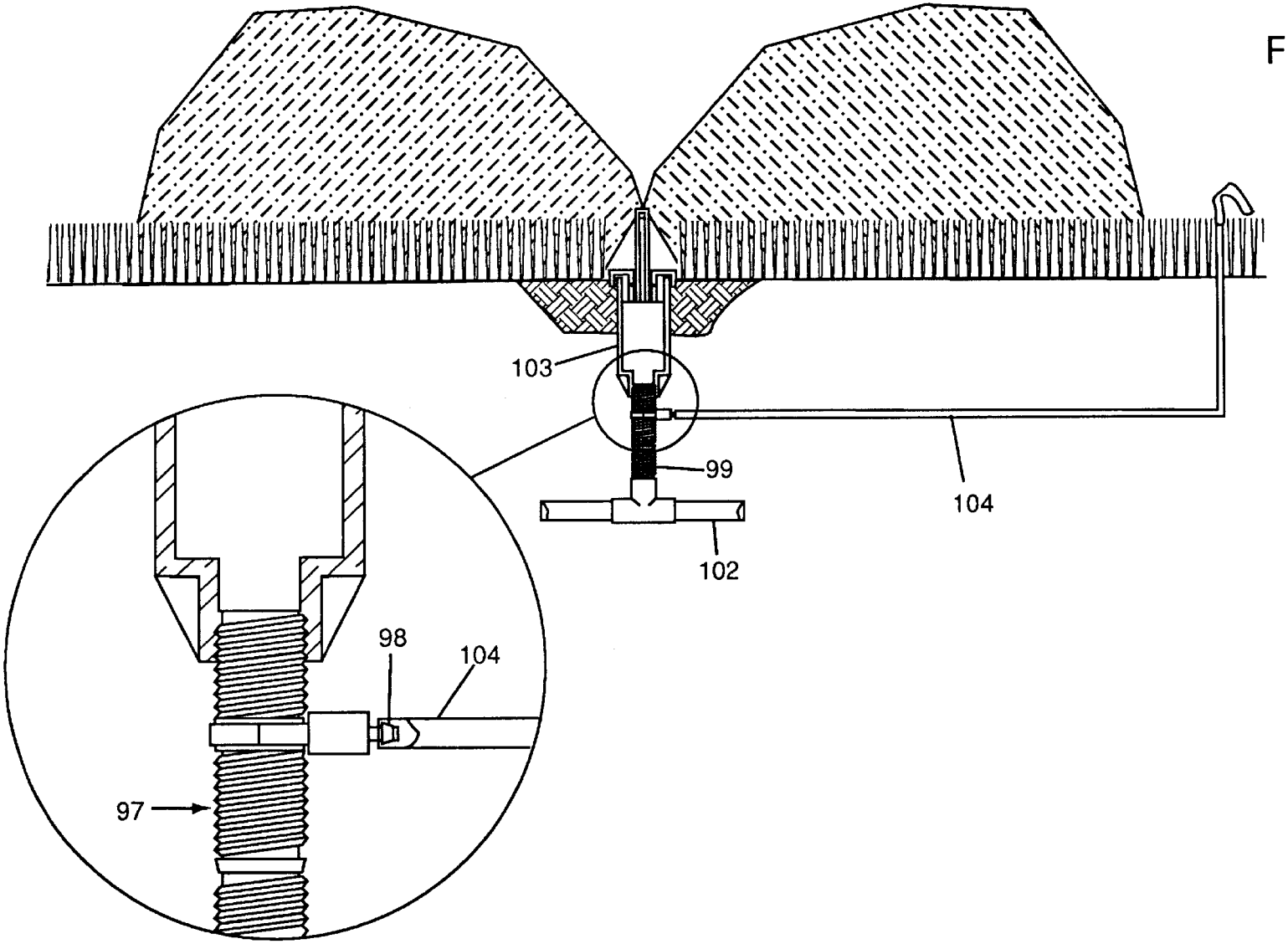
FIG. 10 is a side view of the form of the invention shown in FIG. 9 as installed in a typical sprinkler irrigation system.

FIG. 9 illustrates another form of the invention and FIG. 10 illustrates an installation for this alternate form. Referring to FIG. 9, the irrigation device 97 includes an upper threaded connection 98 to which a sprinkler head may be secured. The device 97 also includes a water distribution passage having a barbed outlet end 98. Although not shown in the drawing, the water distribution passage has associated with it a flow control and may also include a valve similar to those illustrated in FIG. 1. The lower portion of the device 97 includes a riser portion 99. The riser portion 99 includes a plurality of axially aligned threaded connections 100. The riser portion 99 may thus be cut to a desired length leaving one of the axially aligned threaded connections 100 in position to connect to a riser connection 101 associated with a water supply conduit 102 (FIG. 10).

Referring to FIG. 10, the device 97 replaces a standard riser which connects a standard sprinkler head 103 to the water supply conduit 102. A conveyance channel 104 which may be connected to the outlet end 98 of the water distribution passage may extend to an emission point 105 in a deficiency area within the sprinkler head pattern or to an area completely outside of the sprinkler head pattern.

The above described preferred embodiments are intended to illustrate the principles of the invention, but not limit the scope of the invention. Various other embodiments and modifications to these embodiments may be made by those skilled in the art without departing from the scope of the invention as described. For example, although the Figures illustrate pop-up type sprinkler heads, a sprinkler head within the scope of the invention may include a pop-up spray type sprinkler, an impact sprinkler, a gear driven rotor sprinkler, or any other type of sprinkler device. Also, each embodiment of the invention may include a plurality of water distribution passages or a single water distribution passage.

I claim:

1. An apparatus for providing low volume irrigation to at least one discrete emission point from a previously installed sprinkler irrigation system which includes one or more at least partially buried sprinkler heads connected to a subsurface water supply conduit, the apparatus comprising:

(a) a manifold having at least one water distribution passage, each water distribution passage having an inlet end and an outlet end, and the outlet end of each water distribution passage being adapted to receive a conveyance channel for distributing water to a discrete emission point within an area to be irrigated;

(b) flow control means associated with each water distribution passage for controlling the flow rate of water through the respective water distribution passage to a rate exceeding approximately ten gallons per hour; and (c) connecting means associated with the manifold for connecting the manifold to receive water supplied to the sprinkler head so that the water supplied to the sprinkler head may enter the inlet end of each water distribution passage and flow through the respective water distribution passage to the respective conveyance channel.

2. The apparatus of claim 1 wherein the sprinkler head includes a sprinkler head body having a top threaded connection adapted to receive a sprinkler mechanism and wherein:

(a) the connecting means comprises a threaded connector adapted to connect the manifold to the top threaded connector; and (b) the manifold comprises a cap adapted to substantially cover the sprinkler head body when connected to the top threaded connection.

3. The apparatus of claim 2 wherein the manifold includes:

(a) a sprinkler element opening therethrough; and (b) a sprinkler element slidably received in the sprinkler element opening.

4. The apparatus of claim 1 further comprising:

(a) a valve associated with each water distribution passage, each valve for selectively blocking the flow of water to the respective water distribution passage.

5. The apparatus of claim 1 wherein the manifold includes a plurality of water distribution passages.

6. The apparatus of claim 1 wherein the spray head includes a lower threaded connector and wherein:

(a) the connecting means includes a threaded connector adapted to connect to the lower threaded connector of the spray head; and (b) the manifold includes an elongated riser portion comprising a plurality of axially aligned threaded connectors, enabling the riser portion to be cut to a desired length leaving one of said axially aligned threaded connectors in position to connect to the water distribution conduit.

7. The apparatus of claim 1 wherein each sprinkler head includes a lower threaded connector and wherein the connecting means includes:

(a) a lower manifold connector adapted connect to a threaded riser from the water supply conduit; and (b) an upper manifold connector adapted to connect to the sprinkler head lower threaded connector.

8. An apparatus for providing low volume irrigation to at least one discrete emission point from a previously installed sprinkler irrigation system including a water supply conduit having a riser connection therein, the apparatus comprising:

(a) a device body having a chamber formed therein;

(b) at least one water distribution passage associated with the device body, each water distribution passage having an inlet end open to the chamber of the device body and an outlet end adapted to connect to a conveyance channel for distributing water to a discrete emission point;

(c) flow control means associated with each water distribution passage for controlling the flow rate of water through the respective passage to a rate exceeding approximately ten gallons per hour; and (d) connecting means associated with the device body for connecting the device body to receive water from the water supply conduit through the riser connection associated therewith.

9. The apparatus of claim 8 wherein:

(a) the device body includes a threaded top connection;

(b) the apparatus further includes a manifold cap having a threaded connection adapted to connect to the threaded top connection of the device body; and (c) each water distribution passage is formed in the manifold cap.

10. The apparatus of claim 9 wherein the manifold cap includes:

(a) a sprinkler element opening therethrough; and (b) a sprinkler element slidably received in the sprinkler element opening.

11. The apparatus of claim 9 wherein:

(a) the device body includes a top connection;

(b) the connecting means includes an elongated riser portion at an end of the device body opposite to the top connection, the elongated riser portion comprising a plurality of axially aligned threaded connectors, enabling the riser portion to be cut to a desired length leaving one of said plurality of axially aligned threaded connectors in position to connect to the riser connection associated with the water supply conduit.

12. A method of providing low volume irrigation from a sprinkler irrigation system which includes a subsurface water supply conduit and a subsurface sprinkler head connector associated therewith, a method comprising the steps of:

(a) supplying water through the sprinkler head connector to a manifold connected thereto;

(b) directing water from the manifold to a location within an area to be irrigated, through a buried conveyance channel having an emission end substantially at the surface in the area to be irrigated; and (c) controlling the flow through the conveyance channel to a rate exceeding the local hydraulic loading rate of the area adjacent to the conveyance channel emission end to produce localized run-off around the emission end and an extended wetting pattern around said emission end.

13. The method of claim 12 including the steps of:

(a) directing water from the manifold to a plurality of locations within the area to be irrigated, each through a buried conveyance channel having an emission end substantially at the surface in the area to be irrigated;

(b) controlling the flow through each conveyance channel to a rate exceeding the local hydraulic loading rate of the area adjacent to the respective conveyance channel emission end to thereby produce localized run-off around each emission end and an extended wetting pattern around each emission end; and (c) the extended wetting pattern associated with the plurality of conveyance channels combining to cover a total area to be irrigated.

14. The method of claim 12 further comprising the step of:

(a) simultaneously with directing water through the buried conveyance channel, directing water through the sprinkler head connector to a sprinkler head associated with the manifold, so as to spray water droplets in a desired pattern around the sprinkler head.

* * * * *